US008261393B2

(12) United States Patent
Honeycutt et al.

(10) Patent No.: US 8,261,393 B2
(45) Date of Patent: Sep. 11, 2012

(54) FALL RESTRAINT EQUIPMENT COMPONENT AND METHOD FOR MANUFACTURING THE SAME

(75) Inventors: Robert W. Honeycutt, Pawleys Island, SC (US); Thomas A. Mefferd, Mt. Pleasant, SC (US)

(73) Assignee: Saferack, LLC, Andrews, SC (US)

( * ) Notice: Subject to any disclaimer, the term of this patent is extended or adjusted under 35 U.S.C. 154(b) by 487 days.

(21) Appl. No.: 12/468,704

(22) Filed: May 19, 2009

(65) Prior Publication Data

US 2010/0031456 A1 Feb. 11, 2010

Related U.S. Application Data

(60) Provisional application No. 61/087,732, filed on Aug. 10, 2008.

(51) Int. Cl.
*E01D 1/00* (2006.01)

(52) U.S. Cl. ..... 14/71.3; 14/71.1

(58) Field of Classification Search ..... 182/17, 182/100, 106, 141, 228.1, 241; 14/69.5, 14/71.1, 71.3; 256/1, 47
See application file for complete search history.

(56) References Cited

U.S. PATENT DOCUMENTS

| | | | | |
|---|---|---|---|---|
| 309,320 | A | 12/1884 | Stockbridge | |
| 540,192 | A | 5/1895 | Rosback | |
| 903,157 | A * | 11/1908 | Allen | 119/847 |
| 981,613 | A | 1/1911 | Carter | |
| 1,505,116 | A | 8/1924 | Wiebe | |
| 1,815,048 | A | 7/1931 | Chambers | |
| 1,944,159 | A | 1/1934 | Bailey | |
| 2,326,844 | A | 8/1943 | Ely | |
| 3,095,848 | A | 7/1963 | Adolph | |
| 3,869,109 | A | 3/1975 | Russo | |
| 4,072,294 | A | 2/1978 | Densen | |
| 4,106,150 | A * | 8/1978 | Irwin | 14/71.3 |
| 4,133,283 | A | 1/1979 | Ryan | |
| 4,154,318 | A | 5/1979 | Malleone | |
| 4,161,795 | A | 7/1979 | Quest | |
| 4,168,764 | A | 9/1979 | Walters | |

(Continued)

FOREIGN PATENT DOCUMENTS

| | | |
|---|---|---|
| GB | 2275632 | 9/1994 |

OTHER PUBLICATIONS

PCT International Search Report and Written Opinion of the International Searching Authority dated Sep. 24, 2009 for PCT/US2009/053285 filed on Aug. 10, 2009, corresponding to co-pending U.S. Appl. No. 12/468,704.

(Continued)

*Primary Examiner* — Gary S Hartmann
(74) *Attorney, Agent, or Firm* — Nelson Mullins Riley & Scarborough LLP; R. Brian Drozd

(57) ABSTRACT

A post to be used in conjunction with a gangway or other fall restraint equipment where the post defines an aperture having an upper portion and a lower portion such that the upper portion is configured to allow a link of a chain to pass there through while the lower portion allows the link to pass through in one orientation but prevents the link from passing through in a second orientation traverse to the first orientation.

7 Claims, 9 Drawing Sheets

U.S. PATENT DOCUMENTS

| | | | | |
|---|---|---|---|---|
| 4,280,243 | A | 7/1981 | Durrant | |
| 4,335,803 | A | 6/1982 | Sugito | |
| 4,712,264 | A | 12/1987 | Voith | |
| 4,768,497 | A | 9/1988 | Winge | |
| 4,838,735 | A | 6/1989 | Warner | |
| 5,010,614 | A | 4/1991 | Braemert et al. | |
| 5,077,852 | A | 1/1992 | Karlsson | |
| 5,097,787 | A | 3/1992 | Bruce | |
| 5,319,818 | A | 6/1994 | Baranowski | |
| 5,402,546 | A | 4/1995 | Baranowski | |
| 5,794,292 | A | 8/1998 | Ricci, Jr. | |
| 5,950,266 | A | 9/1999 | Streeter et al. | |
| 5,994,667 | A | 11/1999 | Merdan et al. | |
| 6,425,572 | B1 | 7/2002 | Lehr | |
| 6,526,614 | B2 | 3/2003 | Anderson et al. | |
| 6,813,792 | B2 | 11/2004 | Miller | |
| 6,923,140 | B1 | 8/2005 | Cook | |
| 7,159,261 | B2 | 1/2007 | Carrigan | |
| 7,383,600 | B2 | 6/2008 | Carrigan | |
| 2002/0066290 | A1 * | 6/2002 | Chen | 63/3 |
| 2002/0189177 | A1 | 12/2002 | Eve et al. | |
| 2004/0107519 | A1 | 6/2004 | Grody | |
| 2007/0161460 | A1 | 7/2007 | Katz et al. | |
| 2009/0144916 | A1 | 6/2009 | Honeycutt et al. | |
| 2010/0031455 | A1 | 2/2010 | Honeycutt et al. | |
| 2010/0032633 | A1 | 2/2010 | Honeycutt | |

OTHER PUBLICATIONS

PCT International Search Report and Written Opinion of the International Searching Authority dated Sep. 24, 2009 for PCT/US2009/053299 filed on Aug. 10, 2009, corresponding to co-pending U.S. Appl. No. 12/487,408.

PCT International Search Report and Written Opinion of the International Searching Authority dated Sep. 28, 2009 for PCT/US2009/053313 filed on Aug. 10, 2009, corresponding to co-pending U.S. Appl. No. 12/537,842.

PCT International Search Report and Written Opinion of the International Searching Authority dated Feb. 6, 2009 for PCT/US2008/85922 filed on Dec. 8, 2008, corresponding to co-pending U.S. Appl. No. 12/329,883.

Office Action issued by the U.S. Patent and Trademark Office on Aug. 13, 2010 for copending U.S. Appl. No. 12/329,883, filed Dec. 8, 2008.

Office Action issued by the U.S. Patent and Trademark Office on Oct. 4, 2010 for copending U.S. Appl. No. 12/487,408.

* cited by examiner

FALL RESTRAINT EQUIPMENT COMPONENT AND METHOD FOR MANUFACTURING THE SAME

CLAIM OF PRIORITY

The present application claims the benefit of the United States provisional patent application filed on Aug. 10, 2008 by Robert W. Honeycutt for COMPONENTS OF SAFETY EQUIPMENT AND METHODS FOR MANUFACTURING THE SAME (Ser. No. 61/087,732), the entire disclosure of which is incorporated by reference as if set forth verbatim herein.

FIELD OF THE INVENTION

The present invention relates generally to fall restraint equipment components. More particularly, the present invention relates to posts for gangways.

BACKGROUND OF THE INVENTION

FIG. 1 illustrates an example of fall restraint equipment comprising a stairwell 16, a platform 18, and a gangway 10. Stairwell 16 ascends to platform 18, where gangway 10 is connected. An optional cage 20 may be connected to gangway 10 if desired. In this example, the fall restraint equipment provides a user with access to a top 14 of a container 12 (such as a railway car). Gangway 10 may be configured to maintain a fixed orientation, which may be useful when accessing the top of successive containers having the same height.

Alternatively, gangway 10 may be configured to pivot with respect to platform 18 in order to raise and lower the end of the gangway opposite the platform so as to provide access to the top of containers exhibiting varying heights. In the case of a pivoting gangway, various other components may be provided to assist a user in accessing top 14. For example, gangway 10 may include a ramp, a telescoping ramp, or multiple self-adjusting or self-leveling stairs (or other suitable supports) that provide access to top 14 once the gangway has been pivoted to a desired position or orientation.

FIG. 2 illustrates a gangway 22 that may be used as gangway 10 of FIG. 1. Gangway 22 comprises a base tread 23, which includes two posts or "uprights" 34 connected to base tread support 24. Uprights 34 are preferably bolted to base tread support 24 but may be connected by other suitable means, such as by welding. Base tread 23 is conventionally connected to a fixed structure, such as platform 18 (FIG. 1). An underbody 30 is pivotally connected to base tread support 24 at one end and another tread, such as seatainer tread 28, at the other end. The pivotal connection between base tread support 24 and underbody 30 allows the distal end of gangway 22 to rotate with respect to a fixed structure, such as platform 18 (FIG. 1) in this example. To maintain gangway 22 in a desired orientation, a pair of heavy duty adjusting chains 200 is provided. One end of each chain 200 is connected to the distal end of underbody 30 (at which seatainer tread 28 is also connected in this case). The opposite end of each chain 200 may be fed through an aperture 204 in a tab 202 extending laterally from a respective upright 34. Additionally, top portions of uprights 34 are configured in the example illustrated by FIG. 2 to receive portions of a respective one of a pair of handrails 40.

Components of fall restraint equipment, such as gangways, are generally formed by welding smaller pieces of metal together wherever portions of tubular or sheet metal intersect. For instance, a ramp, step, or other support exhibiting the shape of a rectangular prism having front, back, left side, right side, and top surfaces is formed by welding five separate pieces of metal together. In a similar fashion, upright 34 is formed from smaller pieces which are predrilled or otherwise cut in the final shape. The smaller pieces are then welded together and/or to a longer piece of tubular metal to yield upright 34. For instance, smaller, individual pieces are drilled or otherwise cut separately to accommodate for the area that receives a portion of handrail 40 once all the separate pieces are welded together. Tab 202 is formed by drilling or otherwise cutting the tab from a larger piece of metal. Aperture 204 is then created by drilling or otherwise cutting the aperture into tab 202. Tab 202 is then welded to an outer surface of upright 34. Manufacturing components for fall restraint equipment in such a manner is a protracted process and increases the cost of the finished product.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
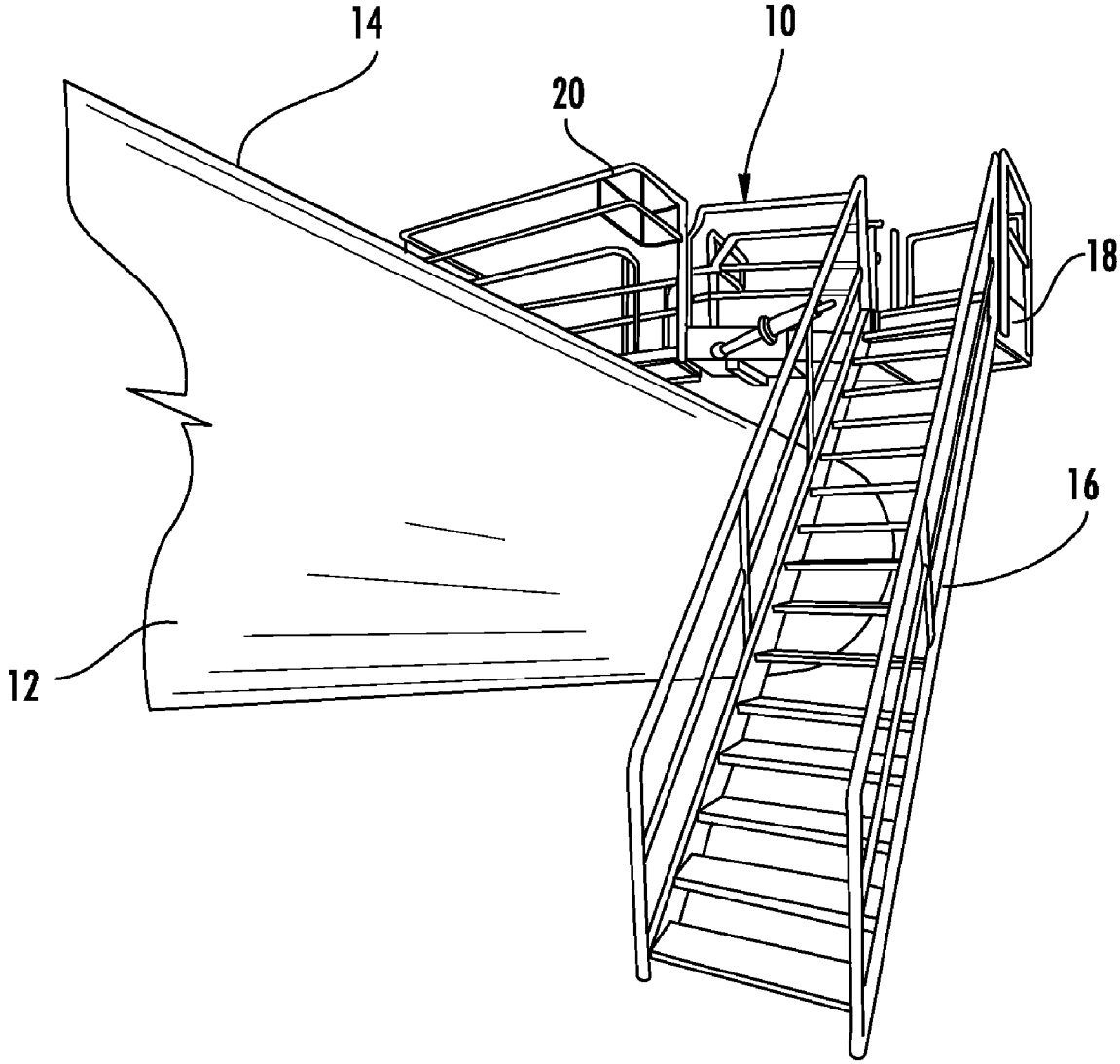
FIG. 1 (PRIOR ART)
FIG. 1 is a perspective view of an exemplary fall restraint system.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
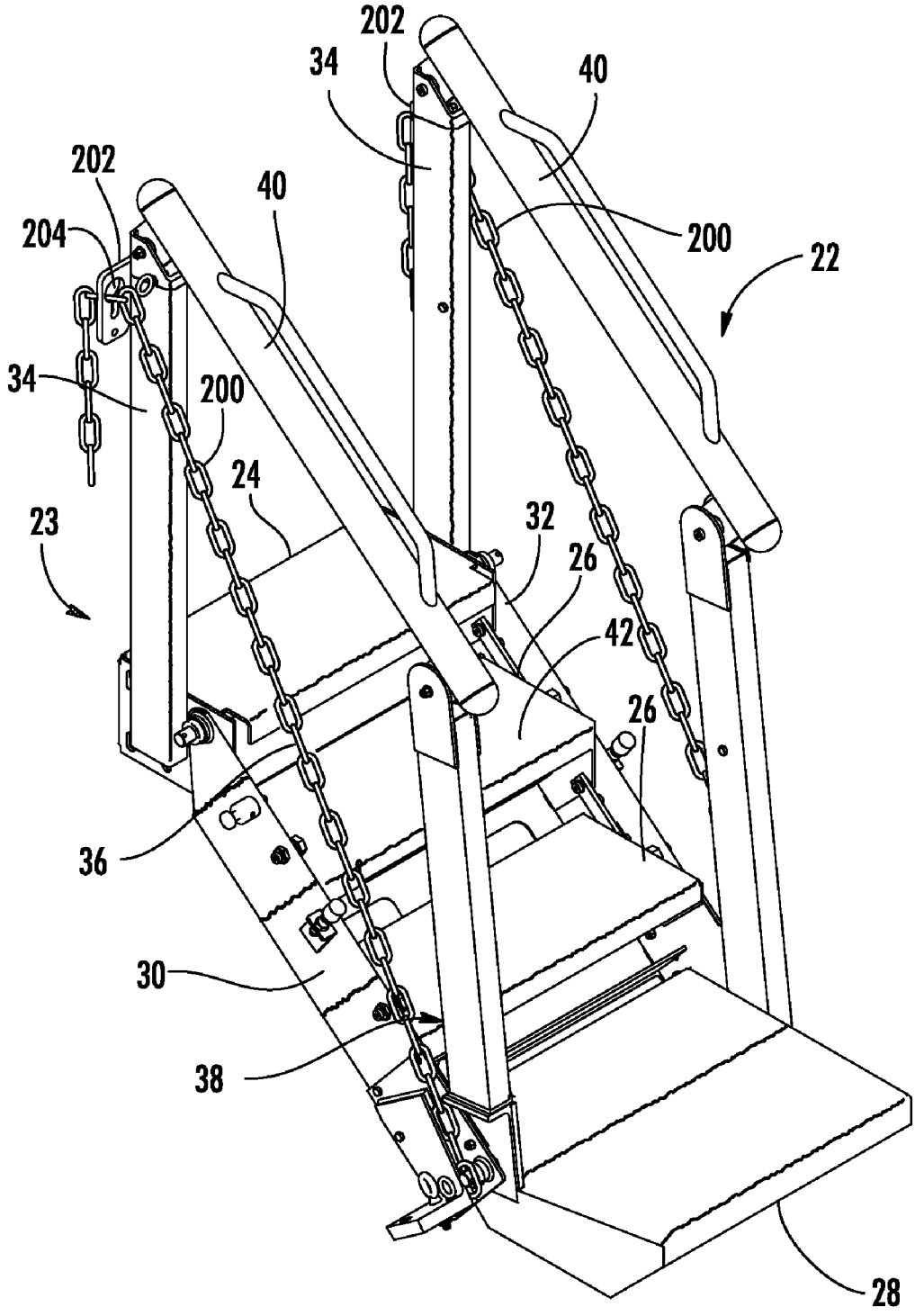
FIG. 2 (PRIOR ART)
FIG. 2 is a perspective view of a gangway that may have been used in the system of FIG. 1.
Figure 3:
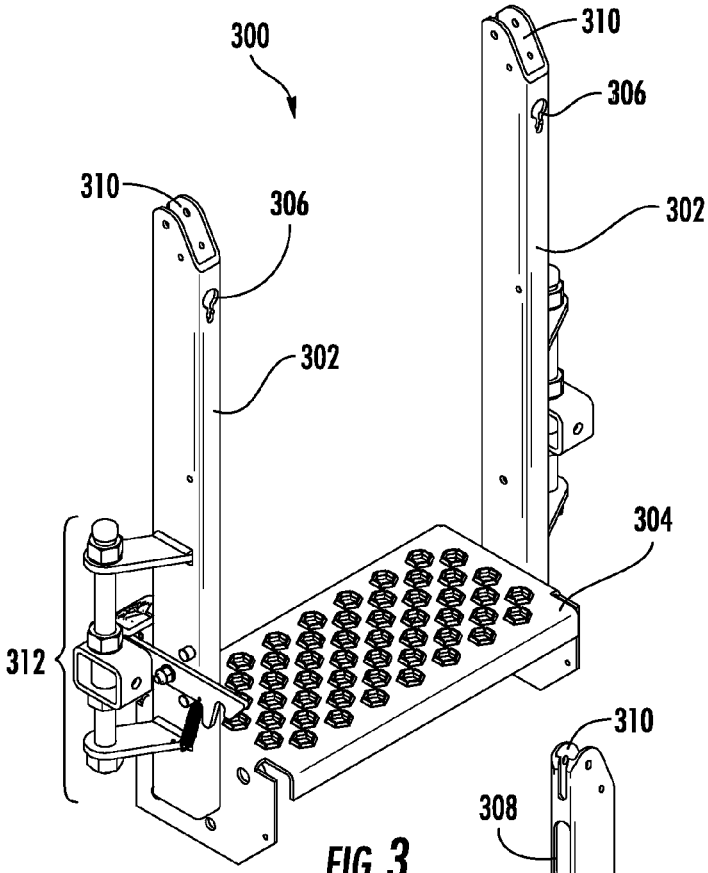
FIG. 3 is a front perspective view of a base tread of a gangway in accordance with an embodiment of the present invention.
Figure 4:
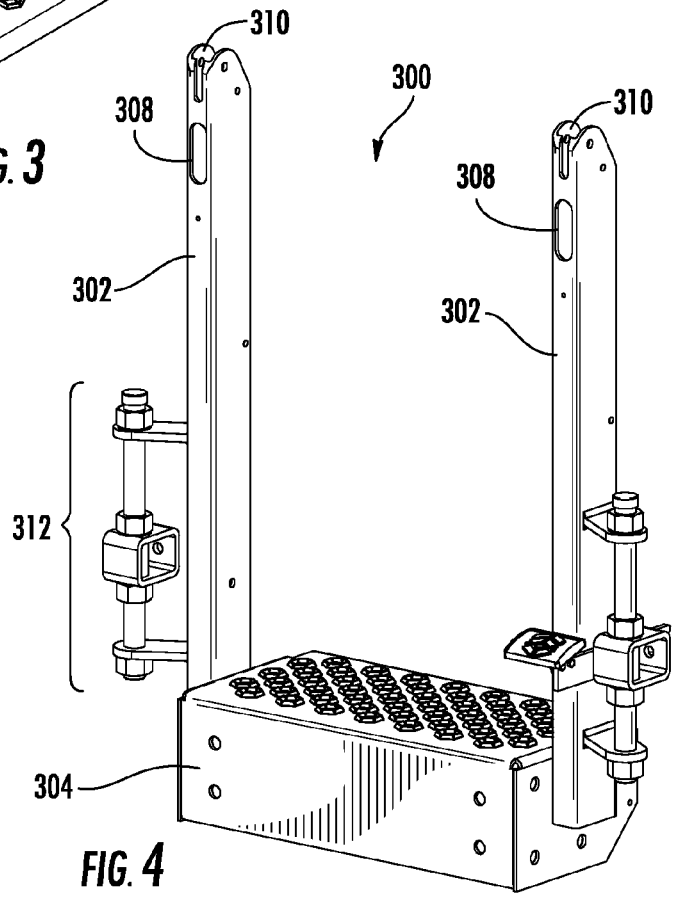
FIG. 4 is a rear perspective view of the base tread of FIG. 3.
Figure 5A:
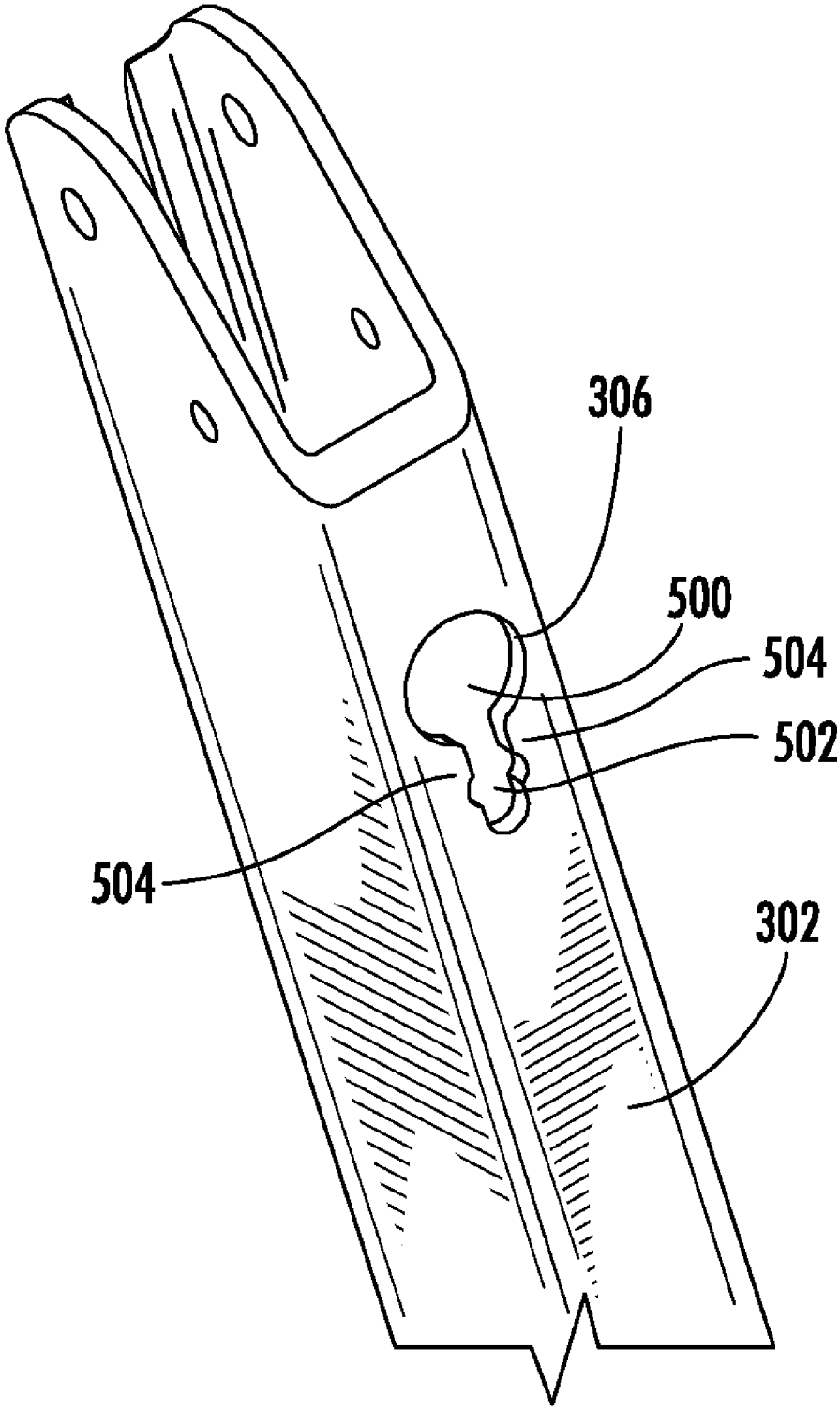
FIG. 5A is a perspective view of a top portion of an upright of the base tread of FIG. 3.
Figure 5B:
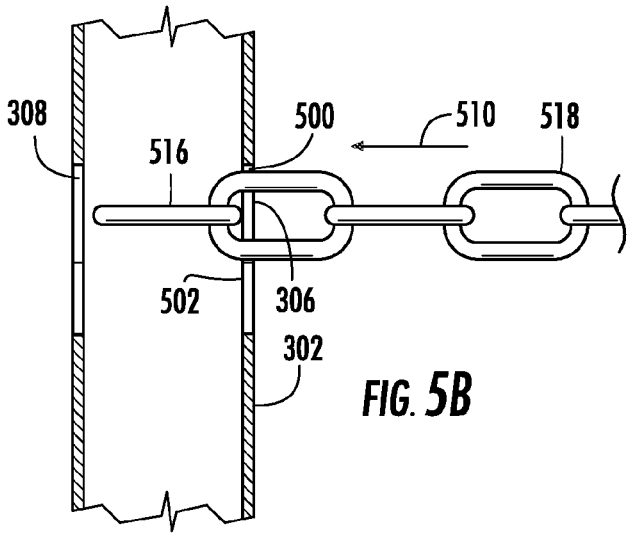
FIGS. 5B through 5D are cross-sectional views of the top portion of the upright of FIG. 5A illustrating a use of the upright in accordance with an embodiment of the present invention.
Figure 5C:
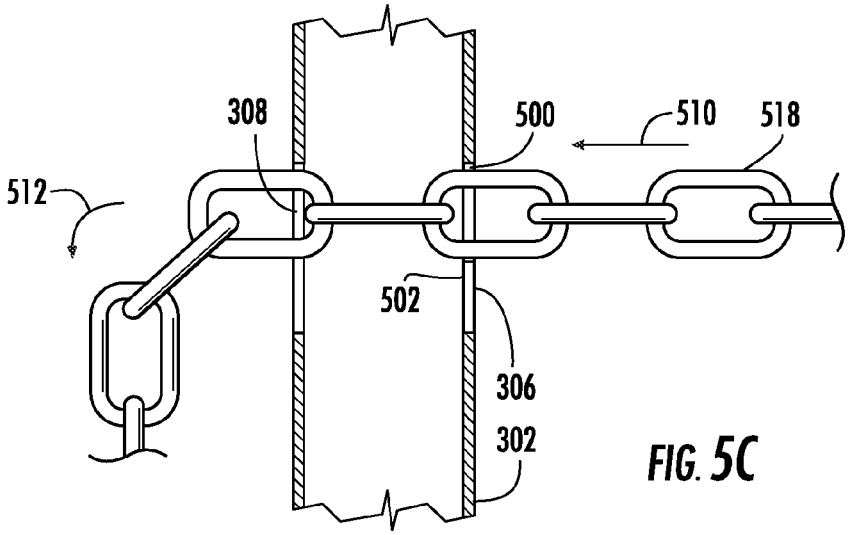
Figure 5D:
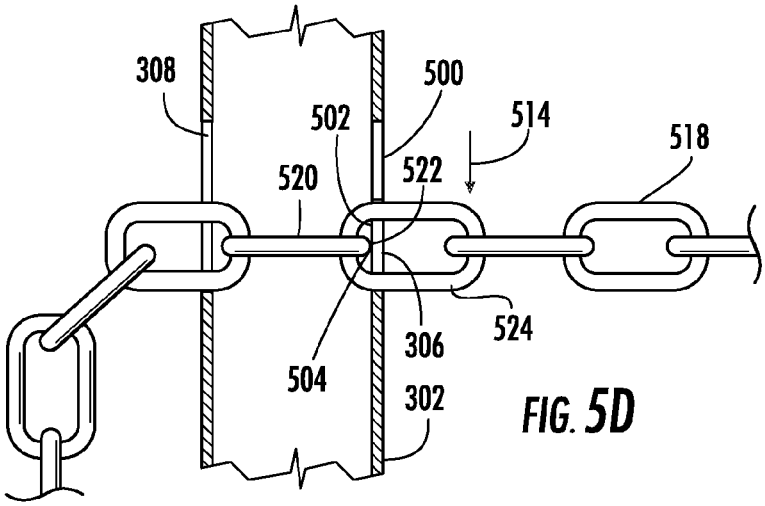
Figure 6:
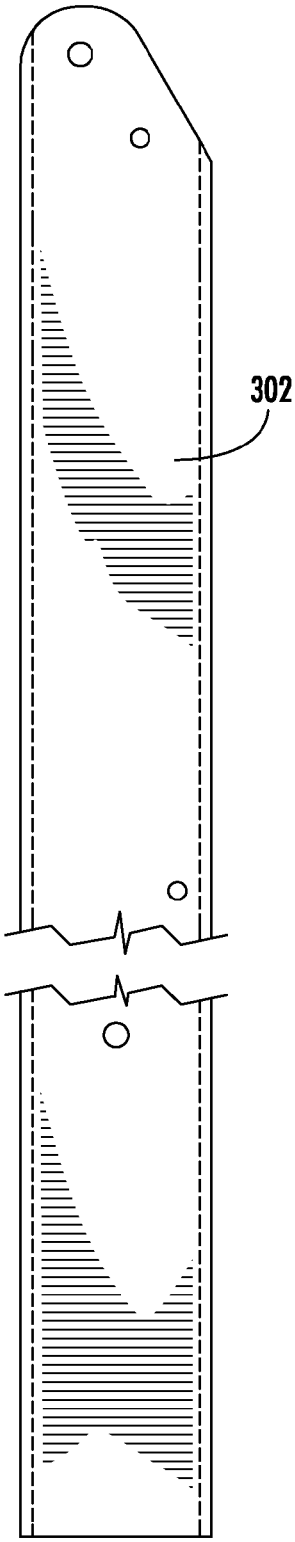
FIGS. 6, 7, and 8 are left side, front, and back elevation views, respectively, of the upright of the base tread of FIG. 3.
Figure 7:
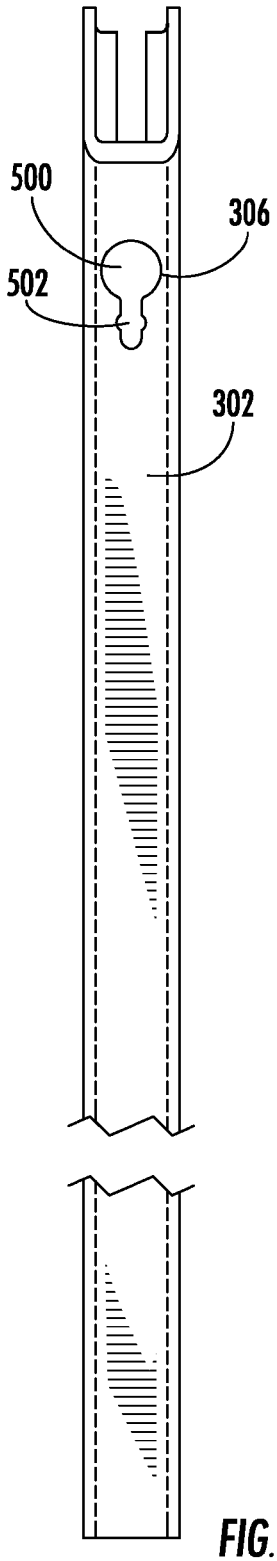
Figure 8:
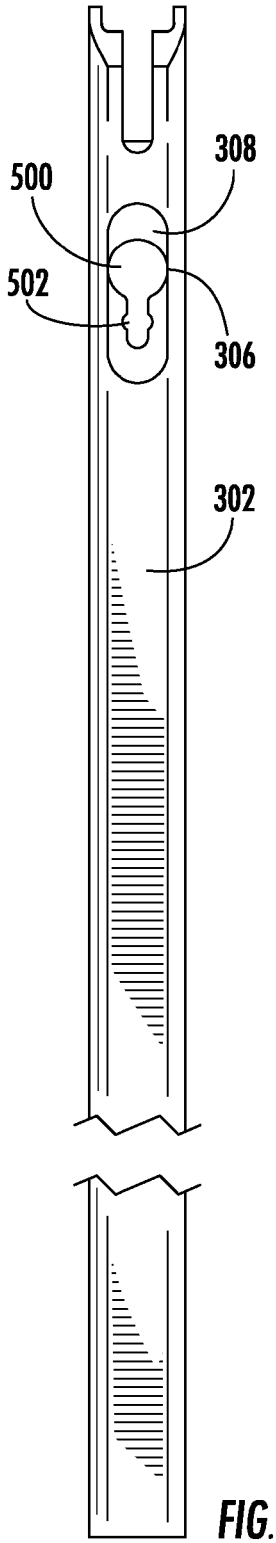

FIGS. 3 and 4 illustrate a base tread 300, which may be substituted for the base tread 23 of gangway 22 (FIG. 2). Additional information regarding the construction and operation of gangways is contained in U.S. patent application Ser. No. 12/329,883, the entire disclosure of which is hereby incorporated by reference as if set forth verbatim herein. Base tread 300 comprises two uprights 302 connected to a tread or support 304. As shown, the front surface of each upright 302 defines an aperture 306. The rear surface of each upright defines a second, larger aperture 308 opposite respective aperture 306. For example, aperture 308 may have an elliptical configuration. It should be understood by those of ordinary skill in the art that uprights 302 are similar in construction and size, because they are mirror images of one another in the present embodiment. It should be further understood that uprights 302 alternatively may be any size depending on their intended use and purpose, as well as the size and configuration of the corresponding gangway. Each upright 302 also defines an area 310 configured to receive a portion of a respective handrail, such as handrail 40 of FIG. 2. Additional components, such as bracket assembly 312, may be connected to base tread 300 in order to facilitate the connection of the base tread to a gangway or other components of the gangway, as describe below.

Referring to FIGS. 5A through 8, aperture 306 is defined by a larger, upper area 500 and a smaller, lower area 502. In this case, upper area 500 has a generally circular shape. The sides of lower area 502 are defined by opposing tabs 504. Referring specifically to FIGS. 5B, 5C, and 5D, an end 516 of a chain 518 (corresponding to chain 200 of FIG. 2) may be fed through portion 500 of aperture 306 and then through aperture 308 as indicated by arrows 510 and 512. Any excess links of chain 518 passing through aperture 308 fall behind upright 302. It should be understood that the size of portion 500 of aperture 306 preferably allows links of chain 518 to pass completely through portion 500 regardless of the links' orientation. For example, portion 500 may have an inner diameter which is slightly greater than the minor axis width of a single link. Portion 502, however, is configured to prevent a link in chain 518 from passing through it in a horizontal orientation.

Once a user pulls a desired length of chain 518 through upper portion 500 of aperture 306 sufficient to maintain the corresponding gangway in a desired position, chain 518 is lowered (as indicated by arrow 514) so that a link 524 will be at least partially received in portion 502. That is, the user adjusts link 524 into a vertical orientation and lowers it into the area defined by portion 502. It should be understood by one of ordinary skill in the art that the vertical orientation of link 524, the interconnection of adjacent links of chain 518, and the configuration of tabs 504, cause a link 520 that is connected to link 524 to exhibit a horizontal orientation. It should be further understood that the weight of the component to which the distal end of chain 518 is connected, such as the underbody, applies an opposite direction pulling force on the chain. In other words, the gravitational force pulls chain 518 toward the component and away from upright 302, thereby causing link 520 to engage tabs 504 with reference to the component (as indicated at 522) and also causing the link to exhibit a horizontal orientation. The configuration of portions 502 thus prevents link 520 from passing back through aperture 306. As a result, chain 518 is secured in a fixed orientation. Accordingly, this also maintains the component of the gangway, to which the distal end of chain 518 is connected, in a fixed orientation.

Figure 9:
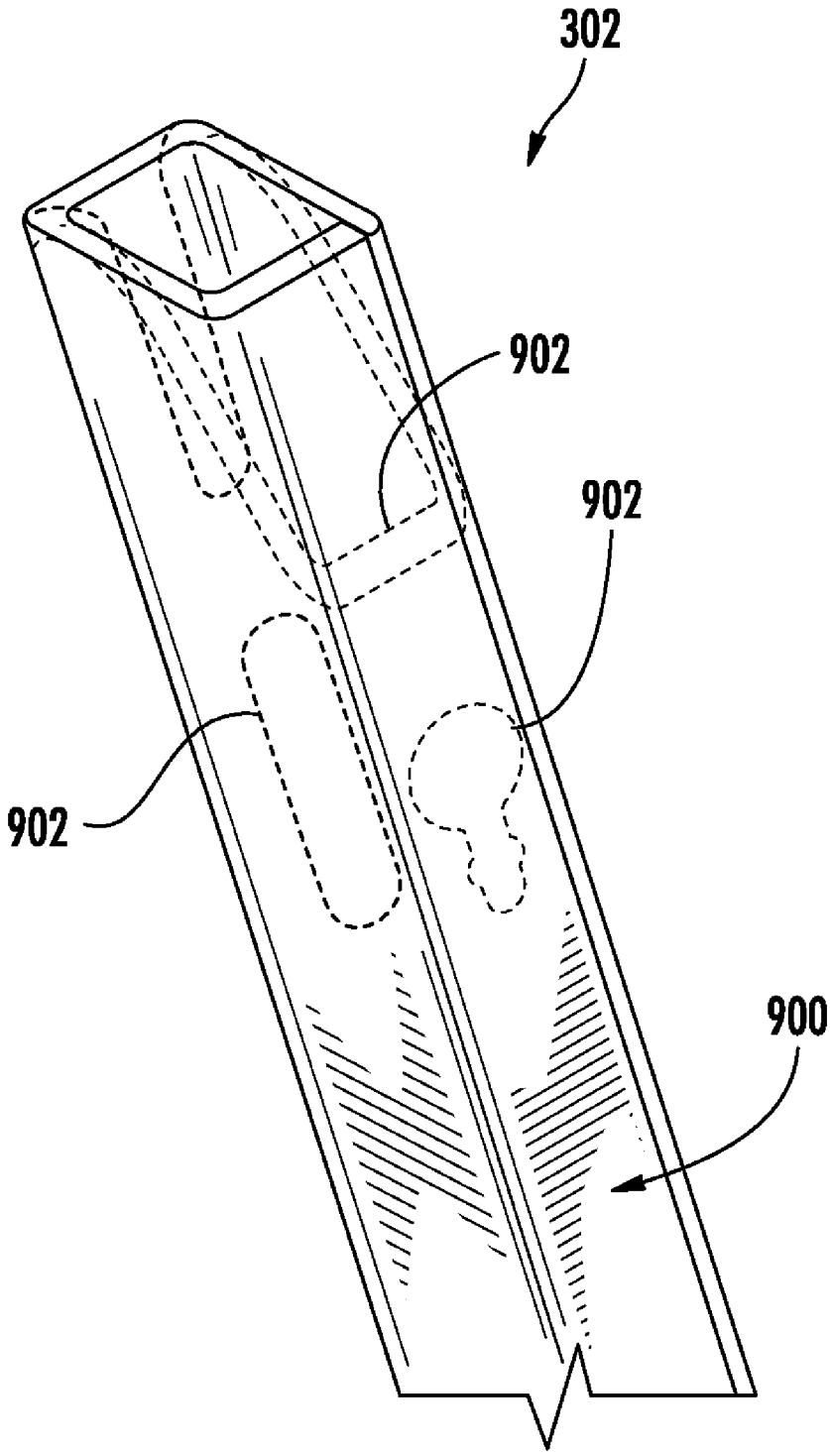
FIG. 9 is a perspective view of a piece of tubular metal used to form an upright of a base tread of a gangway in accordance with an embodiment of the present invention.

FIG. 9 illustrates the formation of upright 302 from a continuous piece 900 of tubular metal. Continuous piece 900 of tubular metal is butterflied, lasered, stamped, notched, or otherwise cut along various hash lines (denoted at 902) in order to form upright 302. Preferably, continuous piece 900 of tubular metal is formed from two inch by four inch tubular carbon steel having a thickness of a quarter inch, but may be formed from tubular pieces of metal exhibiting other sizes and thicknesses depending on the desired size and weight of upright 302. Additional apertures may be lasered or otherwise cut into upright 302, such as those used to connect the upright to tread 304 (FIGS. 3 and 4) via a bolt, other fastener, or welding, as needed or desired. It should be understood from the above description that upright 302 defines apertures 306 and 308 integrally within continuous piece 900 of tubular metal. This is, apertures 306 and 308 are not created by welding or otherwise attaching additional, separate pieces of metal to the upright.

Figure 10:
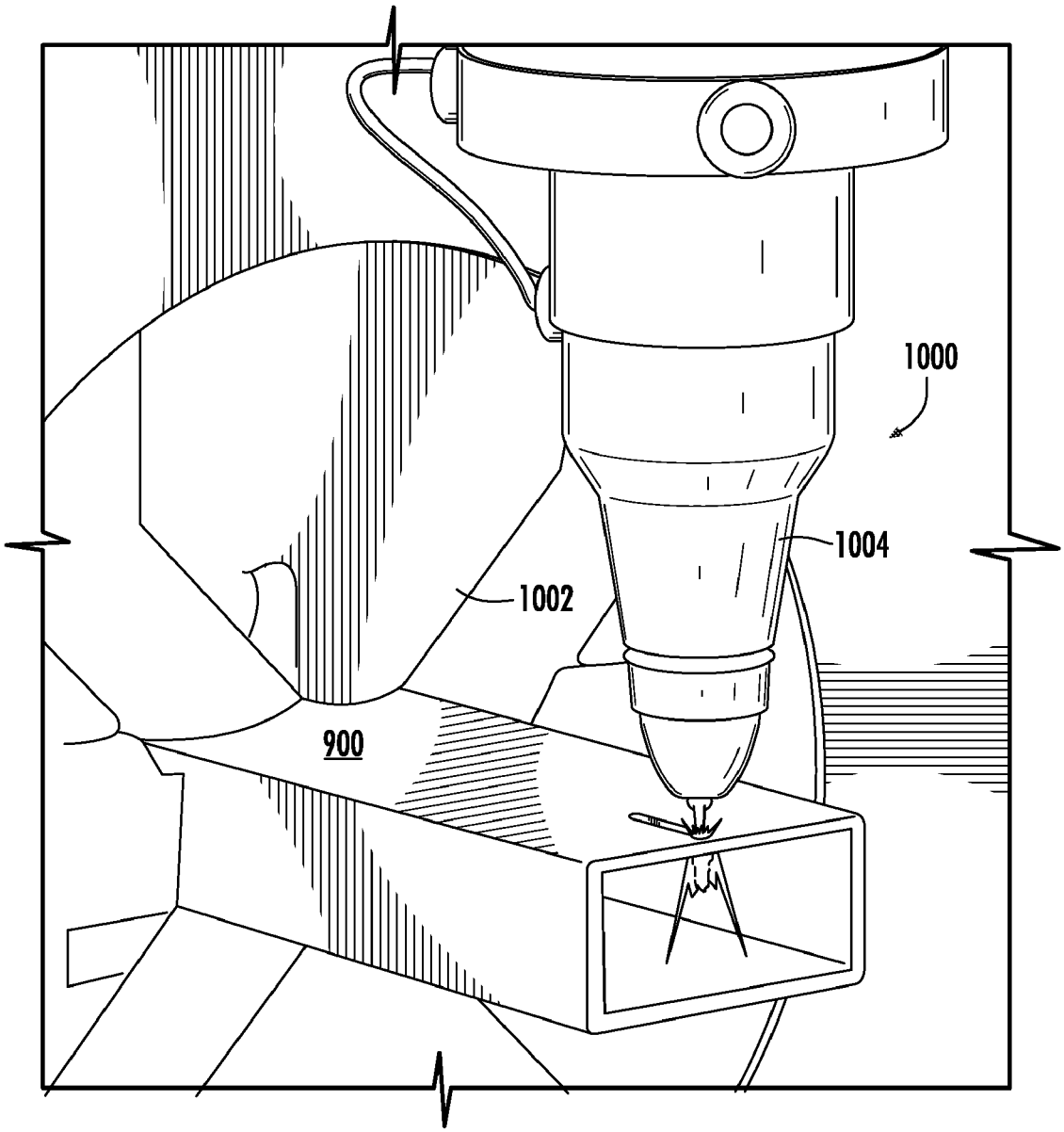
FIG. 10 illustrates an exemplary process of forming the upright of the base tread of FIG. 3.

Referring to FIG. 10, a cutting apparatus, such as a tube laser 1000, may be used to laser or otherwise cut continuous piece 900 of tubular metal in order to form upright 302 (FIGS. 3 and 4). In this case, continuous piece 900 of metal is inserted into a holding mechanism 1002 of tube laser 1000, which moves and rotates the continuous piece while a laser 1004 emits a beam that penetrates the metal. In this manner, tube laser 1000 cuts continuous piece 900 of metal to form the indentations and apertures described above with respect to FIGS. 5A through 9. Tube laser 1000 further comprises a processor and a processor-readable medium containing computer instructions that, when executed by the processor, perform the function of providing a graphical user interface ("GUI"). The GUI allows a user to provide tube laser 1000 with the desired dimensions of continuous piece 900 of metal and the location and dimensions of the portions of the piece that need to be cut and removed in order to form upright 302. Based on these instructions provided by the user, which are stored on the processor-readable medium, the processor instructs tube laser 1000, and more specifically, holding mechanism 1002 and laser 1004, how to rotate, move, and laser continuous piece 900 of metal. It should be understood that other suitable processes may be utilized to cut continuous piece 900 of metal to form upright 302, including the use of a cutting drill, a screw machine, or a handheld plasma or flame torch.

Figure 11:
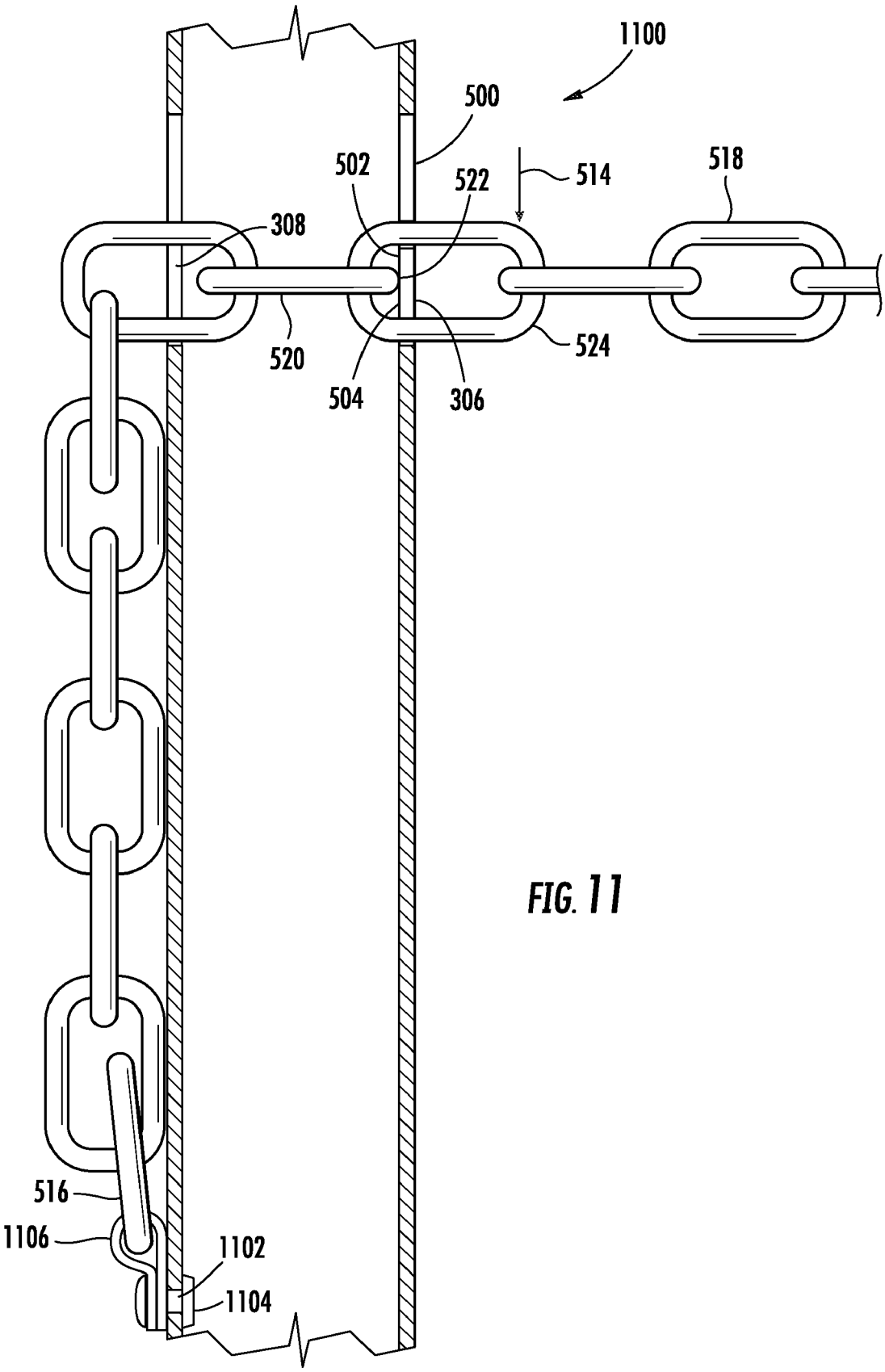
FIG. 11 is a side elevation view of a base tread post in accordance with another embodiment of the present invention.

FIG. 11 illustrates a base tread post 1100 in accordance with another embodiment of the present invention. Base tread post 1100 defines a pin aperture 1102 located on the rear surface of the post and configured to receive a bolt or other suitable fixture, such as rivet 1104 as illustrated. Terminal link 516 of chain 518 is engaged in a metal loop strap 1106 which is secured to base tread post 1100 by rivet 1104 so that the proximate end of the chain is affixed to the base tread post.

Base tread post 1100 is constructed from a continuous piece of tubular metal in a manner similar to that described above with respect to base tread post 302. It should be understood by those of ordinary skill in the art that the continuous piece of tubular metal may be lasered or cut to define pin aperture 1102 at approximately the same time that the other portions of the continuous piece of metal are cut to define and form other areas, as described above with respect to FIG. 9. Other than pin aperture 1102, base tread post 1100 is identical to base tread post 302 (FIG. 3).

In this embodiment, the proximate end of chain 518 is secured to the rear surface of base tread post 1100. This prevents link 516 from returning through aperture 308 when the operator is handling chain 518 and/or moving the respective gangway. That is, the combination of metal loop strap 1106, rivet 1104, and pin aperture 1102 eliminates the possibility for the proximate end of chain 518 to slip through aperture 308, thereby causing the gangway's operator to awkwardly attempt to rethread chain 518 while handling or moving the gangway.

It should be understood by one of ordinary skill in the art that the above description discloses an upright to be used in combination with a base tread of a gangway where the upright is formed from a continuous piece of tubular metal. It should be further understood that the upright defines apertures integral and continuous therewith. The apertures are configured to receive links of a chain attached to additional components of the gangway and may be used to secure the chain. As a result, moveable portions of the gangway attached to the chains are secured in a desired, fixed orientation. Forming the upright from a continuous piece of tubular metal and integrally including the apertures therein provides a more compact upright, which may also weigh less than conventional uprights. One of ordinary skill in the art will also appreciate that manufacturing the upright in the manner described above also reduces the time and costs associating with creating an upright to be used with a gangway.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

The invention claimed is:

1. A gangway comprising:

a base tread;

a first upright post connected to the base tread, wherein the first upright post is formed from a first continuous piece of metal defining a first aperture having a first aperture first portion configured to allow two adjacent links of a plurality of chain links to pass through the first aperture first portion and having a first aperture second portion configured to allow one of the two adjacent links exhibiting a first orientation to pass through the first aperture second portion and to prevent another of the two adjacent links exhibiting a second orientation from passing through the first aperture second portion; and a tread support operatively connected to the base tread in a manner that allows the tread support to rotate with respect to the base tread about an axis defined by the base tread, wherein the tread support is configured to connect to a distal end of the plurality of chain links.

2. The gangway of claim 1 further comprising a second upright post connected to the base tread, wherein the second upright post is formed from a second continuous piece of tubular metal defining a second aperture first portion configured to allow two adjacent links of a second plurality of chain links to pass through the second aperture first portion and having a second aperture second portion configured to allow one of the two adjacent links of the second plurality of chain links exhibiting the first orientation to pass through the second aperture second portion and to prevent another of the two adjacent links of the second plurality of chain links exhibiting the second orientation from passing through the second aperture second portion.

3. The gangway of claim 1 wherein preventing the another of the two adjacent links from passing through the first aperture second portion facilitates maintenance of the tread support in a fixed position.

4. The gangway of claim 2 wherein preventing the another of the two adjacent links of the second plurality of chain links from passing through the second aperture second portion facilitates maintenance of the tread support in a fixed position.

5. The gangway of claim 1 wherein the tread support comprises a plurality of self-leveling steps.

6. The gangway of claim 1 comprising a support structure connected to the base tread in a manner that allows the support structure to rotate with respect to the base tread about the axis defined by the connection of the support structure to the base tread.

7. The gangway of claim 6 wherein the tread support is connected to the support structure.

* * * * *